US005479196A

United States Patent [19]

Inada

[11] Patent Number: 5,479,196

[45] Date of Patent: Dec. 26, 1995

[54] INK JET RECORDING APPARATUS AND METHOD OF RECOVERY INK DISCHARGING CONDITION OF THE SAME

[75] Inventor: Genji Inada, Kawasaki, Japan

[73] Assignee: Canon Kabushiki Kaisha, Tokyo, Japan

[21] Appl. No.: 46,367

[22] Filed: Apr. 13, 1993

Related U.S. Application Data

[63] Continuation of Ser. No. 659,276, Feb. 22, 1991, abandoned.

[30] Foreign Application Priority Data

Feb. 26, 1990 [JP] Japan ..... 2-42518
Feb. 26, 1990 [JP] Japan ..... 2-42519

[51] Int. Cl.[6] ..... B41J 2/01
[52] U.S. Cl. ..... 347/92; 347/60
[58] Field of Search ..... 346/101, 75, 139 R, 346/140 R; 347/92, 65, 61, 60, 30, 35

[56] References Cited

U.S. PATENT DOCUMENTS

| | | | |
|---|---|---|---|
| 4,112,433 | 9/1978 | Vernon | 346/1.1 |
| 4,251,824 | 2/1981 | Hara et al. | 346/140 R |
| 4,291,316 | 9/1981 | Kakeno et al. | 346/140 R |
| 4,313,124 | 1/1982 | Hara | 346/140 R |
| 4,345,262 | 8/1982 | Shirato et al. | 346/140 R |
| 4,393,384 | 7/1983 | Kyser | 346/1.1 |
| 4,419,673 | 12/1983 | Ebi et al. | 346/75 |
| 4,459,600 | 7/1984 | Sato et al. | 346/140 R |
| 4,463,359 | 7/1984 | Ayata et al. | 346/1.1 |
| 4,494,128 | 1/1985 | Vaught | 346/140 R |
| 4,558,333 | 12/1985 | Sugitani et al. | 346/140 R |
| 4,723,129 | 2/1988 | Endo et al. | 346/1.1 |
| 4,740,796 | 4/1988 | Endo et al. | 346/1.1 |
| 5,053,787 | 10/1991 | Terasawa et al. | 346/1.1 |

FOREIGN PATENT DOCUMENTS

| | | |
|---|---|---|
| 54-056847 | 5/1979 | Japan . |
| 59-123670 | 7/1984 | Japan . |
| 59-138461 | 8/1984 | Japan . |
| 60-071260 | 4/1985 | Japan . |
| 62-109655 | 5/1987 | Japan . |
| 62-109648 | 5/1987 | Japan . |
| 0169657 | 7/1987 | Japan . |
| 0240558 | 10/1987 | Japan . |
| 62-238775 | 10/1987 | Japan . |

*Primary Examiner*—N. Le
*Attorney, Agent, or Firm*—Fitzpatrick, Cella, Harper & Scinto

[57] ABSTRACT

An ink jet recording apparatus has a recording head provided with a plurality of ink discharging openings, ink paths leading to the ink discharging openings and an ink chamber commonly connected to the ink paths. Each ink path has a recording thermal energy generating element for causing film boiling of ink in the ink path so as to form a bubble of the ink vapor thereby discharging an ink droplet from the discharging opening. In order to recover from any ink discharging failure caused by bubbles stagnating in the ink paths, the recording thermal energy generating element can be driven in a specific driving condition with a smaller thermal energy input rate than in the recording operation. Tiny bubbles generated in each ink path as a result of the driving form a comparatively large void with which at least a part of the ink in each ink path is replaced so that stagnant bubbles are merged in the void and, hence, extinguished. The void is then discharged by sucking or application of a pressure so that the ink paths are refilled with the ink. The recording head can have an assisting thermal energy generating element which cooperates with the recording thermal energy generating element to ensure good discharge of the ink droplet. The assisting thermal energy generating element element also may be driven for recovery purposes purpose.

15 Claims, 13 Drawing Sheets

INK JET RECORDING APPARATUS AND METHOD OF RECOVERY INK DISCHARGING CONDITION OF THE SAME

This application is a continuation of application Ser. No. 07/659,276, filed Feb. 22, 1991, now abandoned.

BACKGROUND OF THE INVENTION

1. Field of the Invention

The present invention relates to an ink jet recovery method which is carried out to recover the safe ink discharging condition of all ink jet recording head in the event of a discharging failure or which is conducted as a preventive measure for preventing occurrence of such a discharging failure. The invention also is concerned with an ink jet recording apparatus to which the recovery method is applied.

2. Description of Related Arts

In general, an ink jet recording apparatus is a device which records characters or patterns by means of tiny ink droplets discharged from an ink jet recording head. This type of recording device is superior in that it can output a fine and delicate image at a high speed. Known ink jet recording apparatus, however, suffer from a problem in that the ink discharging performance deteriorated to cause ink discharging failure due to various reasons, such as clogging of ink discharge openings in the recording head or introduction of air bubbles or foreign matter into ink paths between the ink discharging openings and a common ink chamber.

This problem is serious particularly in ink jet recording apparatus of a type in which ink droplets are discharged as a result of a change in the ink pressure attributable to a change in the state of the ink effected by generation of a bubble, which is formed as a result of film boiling of the ink caused by heat derived from an electro-thermal converting element (referred to as "discharge heater"). Namely, in this type of ink jet recording apparatus generation of bubbles tends to become unstable due to deposition of dyes of the ink on the discharge heater. Ink discharging failure is caused also by stagnation of bubbles which takes place in specific portions of the ink passages including the aforementioned ink paths leading to the discharging openings, particularly when the temperature of the whole recording device has been raised as a result of long continuous operation.

Japanese Patent Laid-Open (Kokai) No. 62-240558 discloses an ink jet recording apparatus having means serving as a fluid-diode. This fluid-diode means includes an ink heating device separate from the discharge energy generating means which generates the energy for discharging ink droplets. The ink heating means is energized in synchronization with the operation of the discharge energy generating means so as to form a bubble of ink vapor in the ink passage thereby preventing the ink from being displaced in the direction opposite to the openings.

Japanese Patent Laid-Open(Kokai) No. 62-238775 discloses an ink jet recording apparatus in which the pressure of the ink in the ink paths is controlled by vapor of the ink generated by a heating means provided in an ink chamber.

These ink jet recording apparatus suffer from a disadvantage in that the discharge of ink droplets tends to be impaired by stagnation of ink vapor bubbles in specific portions of the ink paths due to unstable generation of bubbles caused by deposition of ink dyes on the heating means.

In order to overcome these problems, it has been proposed to remove stagnat of bubbles or other foreign matter in the ink paths or to prevent such stagnation by sucking the ink from the discharging openings or by purging the bubbles together with the ink from the discharging openings by pressurizing the ink in the ink passage. An ink jet recording apparatus is also known from Japanese Patent Laid-Open-(Kokai) No. 62-109648, in which air is once forced into the ink passage from the discharge side and then discharged. In an ink jet recording apparatus disclosed in Japanese Patent Laid-Open (Kokai) No. 62-109655, air is introduced into an intermediate portion of the ink passage through,for example, a three-way valve so as to force out bubbles together with the ink.

However, mere pressurizing or suction cannot satisfactorily remove bubbles stagnating in stepped portions or corners of the ink passage where the flow resistance is comparatively large. Repetition of the pressurizing or sucking operations for completely expelling bubbles results in a large ink consumption. On the other hand, introduction of air from the discharge side or to an intermediate portion of the ink passage requires a special mechanism for introducing the air in a controlled manner, with the result that the size of the ink discharge recovery system becomes impractically large.

SUMMARY OF THE INVENTION

Accordingly, an object of the present invention is to provide an ink jet recording apparatus, as well as an ink jet recovery method, which can remove bubbles and other foreign matter stagnating in the ink passage of an ink jet recording head without using any special, complicated mechanism and without requiring wasteful use of the ink.

Another object of the present invention is to provide an ink jet recording apparatus comprising: an ink passage communicating with an opening through which ink is discharged; thermal energy generating means disposed in the ink passage and capable of generating thermal energy; driving means for driving the thermal energy generating means so as to form bubbles such that at least a part of ink in the ink passage is replaced with vapor region of the bubbles; and ink filling means for exhausting the vapor region after the replacement so as to enable the ink passage to be refilled with ink.

Still another object of the present invention is to provide a method of recovering an ink discharging condition of an ink jet recording apparatus, comprising the steps of: driving a thermal energy generating means disposed in an ink passage communicated to an ink discharging opening so as to form bubbles in an ink in the ink passage, thereby replacing at least a part of the ink in the ink passage with vapor regions of the bubbles; and exhausting the vapor region from the ink passage and refilling the ink passage with ink.

According to the invention, for the purpose of recovering the normal ink discharging condition, the thermal energy generating means is activated to generate a bubble or void which completely forces out the ink so as to create a state in which ink is absent in the ink passage. Then, the ink passage is refilled with the ink in the same manner as the initial filling of the ink. It is therefore possible to completely remove bubbles of the ink vapor stagnating in the ink passage due to, for example, attaching to the ink passage wall, thus enabling recovery of good ink discharging condition.

These and other objects, features and advantages of the present invention will become clear from the following description of the preferred embodiment when the same is read in conjunction with the accompanying drawings.

DESCRIPTION OF THE PREFERRED EMBODIMENTS

Preferred embodiments of the present invention will be described in detail with reference to the drawings.

Figure 1:
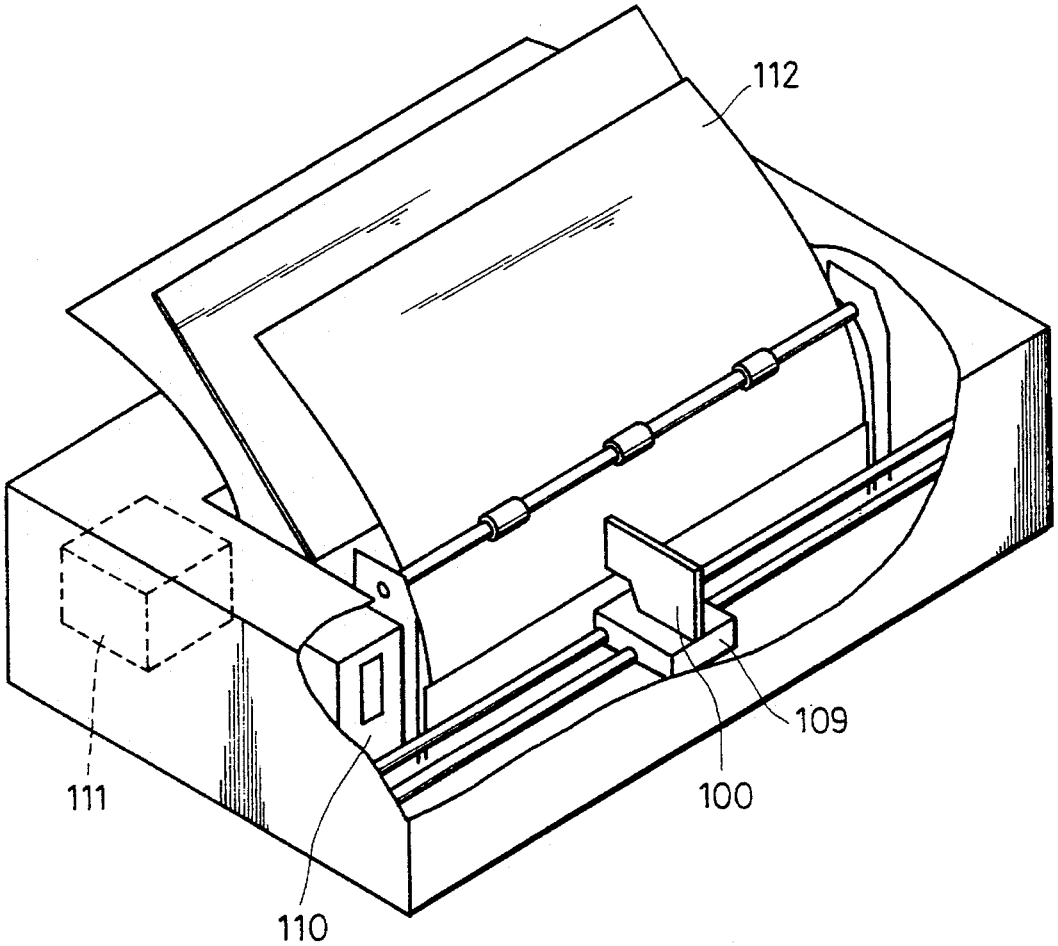
FIG. 1 is a schematic perspective view of an ink jet recording apparatus to which the recovery method of the present invention is applied.

Referring to FIG. 1 which is a schematic perspective view of an embodiment of the ink jet recording apparatus of the present invention, a recording head 100 carried by a carriage 109 is supplied with an ink from an ink tank 111 through an ink supply tube (not shown) and discharges droplets of the ink in a predetermined timing in accordance with recording data signals. The discharged ink droplets fly towards and attach to a recording medium 112 which is being conveyed by a conveyor means (not shown), whereby a desired image is formed by the ink droplets on the recording medium 112 by virtue of a relative movement between the recording head which scans the recording medium and the recording medium which is moved by the conveyor means.

A discharge recovery device 110 for recovering the safe discharging condition of the recording head from a discharge failure is provided, for example, in the vicinity of the home position of the recording head 100. The recovery device 110 may have, for example, a cap capable of covering the surface of the recording head where a plurality of discharge openings open,and a pump for establishing a vacuum in the space closed by the cap so as to suck the ink from the discharge openings. The cap also serves to protect the discharge openings from drying and deposition of contaminants when the recording head 100 is not operating.

Figure 2:
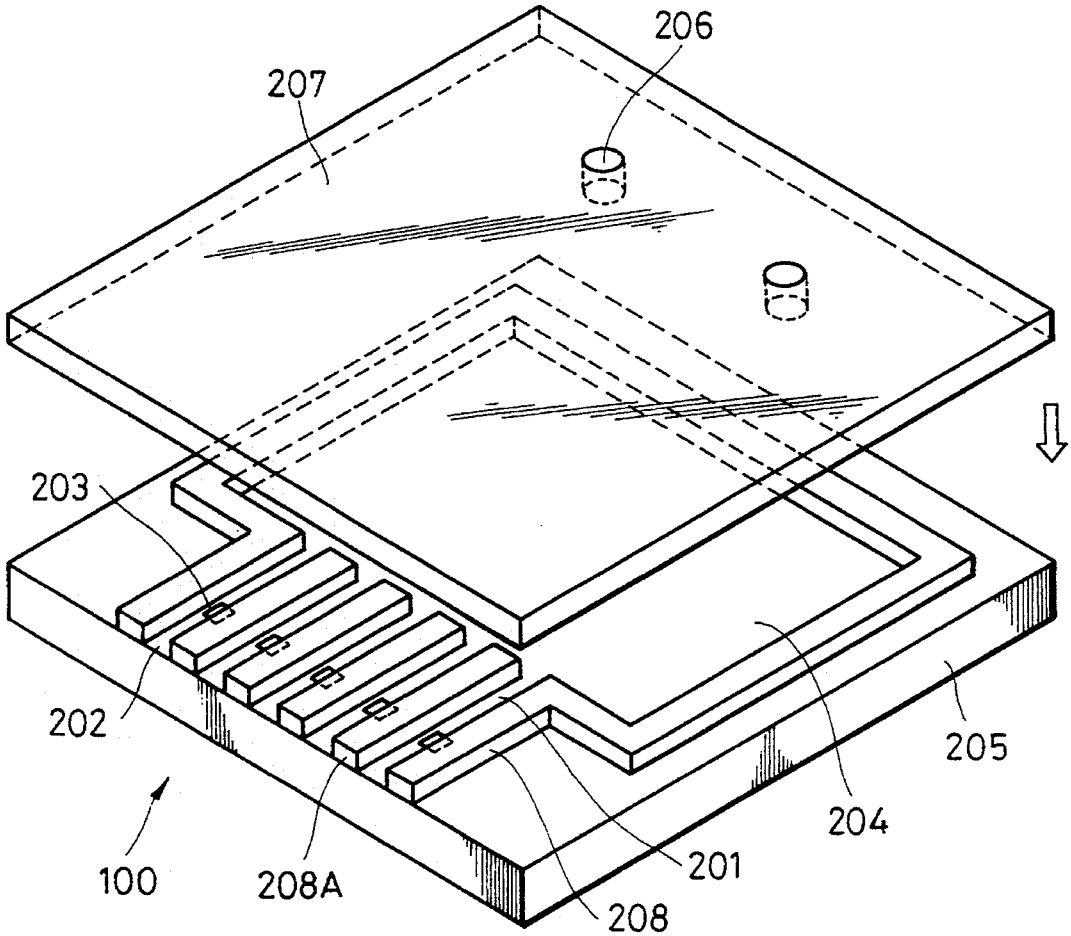
FIG. 2 is an exploded perspective view of a recording head mounted on the ink jet recording apparatus shown in FIG. 1.

FIG. 2 is an exploded perspective view of an example of the recording head 100 used in this embodiment.

The recording head 100 has a substrate 205, and discharge heaters 203 which are provided on the substrate 205 and which are electro-thermal converting elements serving as thermal energy generating means for generating thermal energy used for discharging ink droplets. An outer partition wall 208 and a plurality of ink path partition walls 208A made of, for example, a photosensitive resin, are provided on the substrate 205 and are covered by a top plate 207, whereby an ink passage including ink paths 201 and an ink chamber 204 is formed.

The ink is supplied through ink supply ports 206 formed in the top plate 207 so as to fill the ink chamber 204 and the ink paths 201, and is discharged in the form of droplets from the discharge ports 202 in accordance with the energization of the discharge heaters.

Figure 3A:
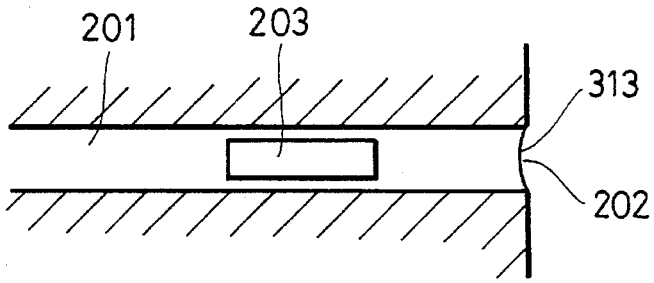
FIGS. 3A to 3C are schematic sectional views of the recording head illustrative of the states of ink inside the recording head when ink droplets are being discharged.
Figure 3B:
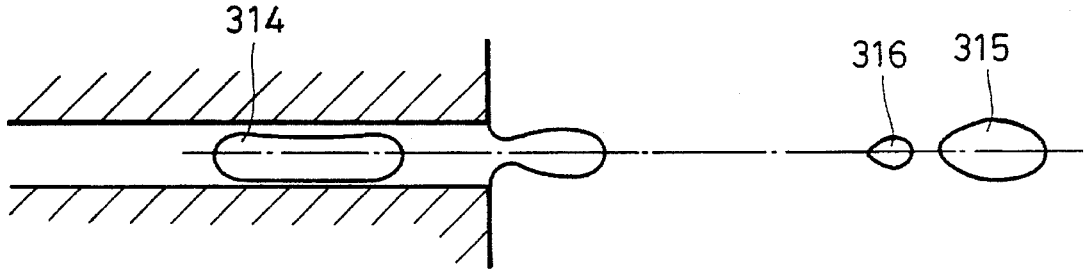
Figure 3C:
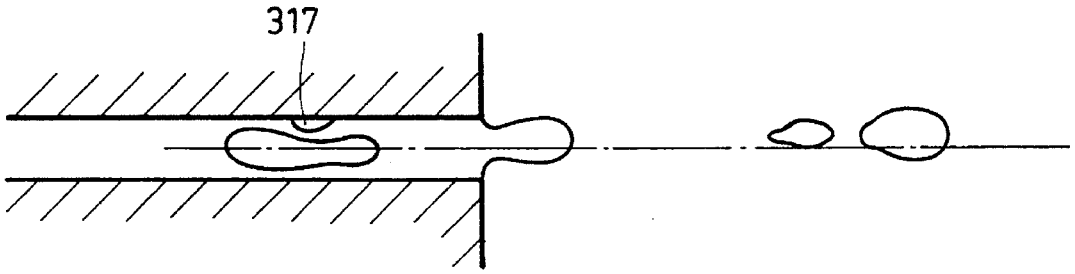

FIGS. 3A to 3C schematically show the state of the ink in an ink path during discharging.

More specifically, when the discharge heater 203 is not energized, the ink path 201 is filled with the ink by capillary action, so that a meniscus 313 is formed as shown in FIG. 3A. When a drive signal corresponding to the recording data is supplied to the discharge heater 203, a bubble 314 of ink vapor is formed on the discharge heater 203, as shown in FIG. 3B. Consequently, if the recording head is in good condition, the ink is displaced by the bubble 314 and discharged in the form of a main ink droplet 315 along the axis of the ink path 201. In some cases, the main ink droplet 315 is accompanied by a sub-droplet 316 which is negligibly small as compared with the main droplet 315.

FIG. 3C shows a state which requires recovery by the recovery method of the present invention, i.e., a state in which a residual bubble 317 stagnates in the ink path. In this case, the ink vapor bubble for driving the ink droplet is deformed due to influence of a tension at the interface between the stagnating bubble 317 and the ink, so that the discharged ink droplet tends to fly in a direction which is offset from the axis of the ink path, causing a degradation in the quality of the recorded image. The present invention provides a method of recovering the ink discharge from an inferior ink discharging state as shown in FIG. 3C by removing the stagnating bubble without fail.

The ink jet recording apparatus of the present invention is used in such a driving condition that, when a pulse voltage as a driving signal is applied to the discharge heater 203, a vapor bubble is formed on the surface of the discharge heater 203 due to film boiling, whereas, when the pulse voltage terminates, the bubble is extinguished very quickly to allow the ink path to be refilled with the ink without allowing stagnation of the ink vapor bubble.

When the recovery method of the invention is carried out, the driving condition is set such that the ink path is filled up with a gas so as to cause any stagnant bubble to be merged in the gas.

Figure 4A:
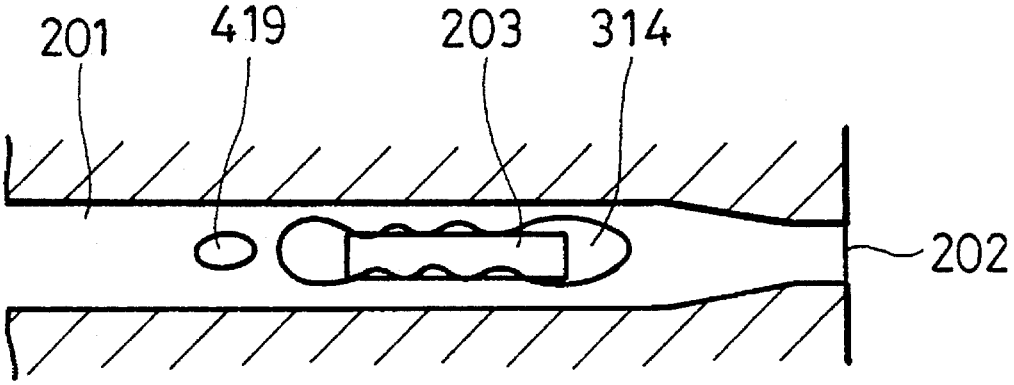
FIGS. 4A and 4B are schematic sectional views of an embodiment of the present invention illustrative of the operation of a discharge heater in the event of a recovery from a discharge failure.
Figure 4B:
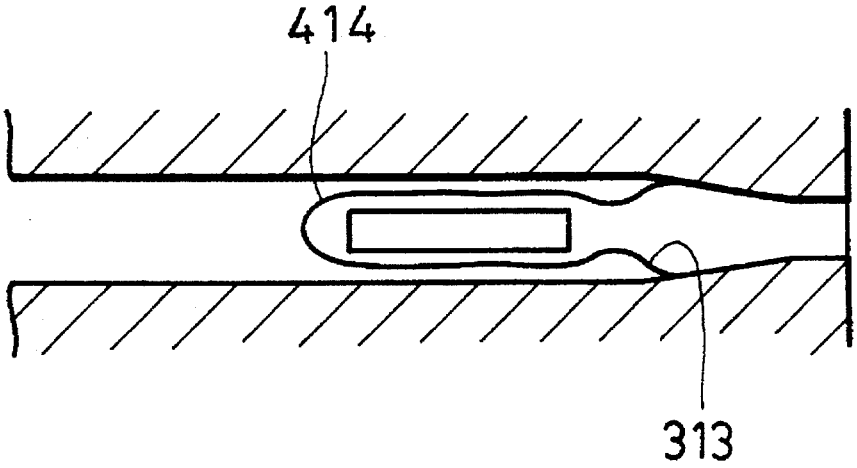

FIGS. 4A and 4B are schematic sectional views of the recording head illustrating the state of formation of bubbles under the discharge heater driving condition set in accordance with the recovery method of the invention. In FIGS. 4A and 4B, the ink path 201 is narrowed or restricted at its outlet end. This, however, does not cause any significant effect on the invention. Referring to FIG. 4A, the amount of energy supplied to the discharge heater 203 is reduced by,for example, lowering the driving voltage as compared with the energy amount supplied during recording. It will be seen that a portion of the vapor forming the bubble has been separated to form a sub-bubble 419 separate from the main bubble 314. It is possible to control the heater such that a plurality of such separate sub-bubbles are formed consecutively and are made to merge in one another to form a vapor space which occupies the whole space inside the ink path, until the gas space communicates with the ambient air as shown in FIG. 4B. According to the position where the bubble stagnates, the expulsion of the ink may be effected by a different method. For instance, the driving frequency of the discharge heater is set to be higher than discharge response frequency of the recording head so as to enable the vapor bubble 314 to grow to merge with the meniscus, thus removing at least a part of the ink in the ink path such that the vapor bubble communicates with the ambient air through the opening of the opening. Any suitable method for expelling the ink from the ink path by the energy from the discharge heater may be used. These methods may be used independently or in combination. The region from which the ink is to be expelled is not limited to a part or whole of the ink path but may cover also the ink chamber if stagnation of bubbles takes place in the ink chamber. The condition of driving of the discharge heater for the purpose of recovery can suitably be determined in accordance with the manner of expulsion of the ink.

Figure 5:
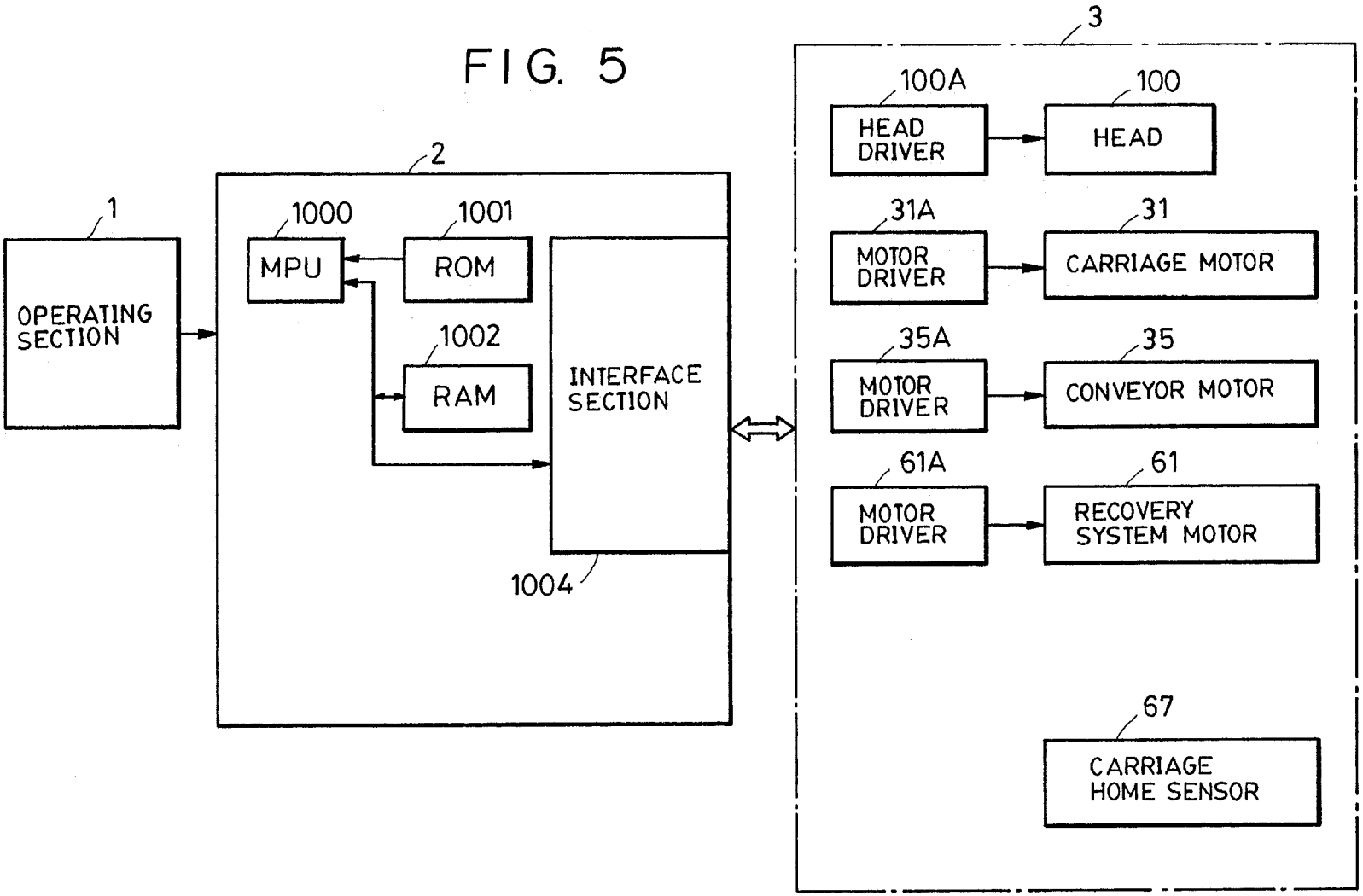
FIG. 5 is a block diagram of an example of a control system incorporated in the present invention.

FIG. 5 is a block diagram of an example of the control system used for controlling the operation of this embodiment of the ink jet recording apparatus.

Numeral 1 denotes an operating section which includes various keys such as an on-line key for communication with a host device (not shown) which is a source of image data, an instruction key for initiating the recording operation, a line-feed key, a form feed key, a recovery instruction key, and so forth. A control section 2 includes an MPU 1000 in the form of a microcomputer capable of controlling various components in accordance with a process which will be described later in connection with FIG. 6, a ROM 1001 storing programs corresponding to the control process and other data, a RAM for use in data processing and other operation, and an interface portion 1004 through which the control section communicates with a printer section 3.

The printer section 3 has a head driver 100A which controls the group of discharge heaters 203 of the recording head 100. A carriage motor 31 drives the carriage 109 relative to the recording medium 112 through, for example, a timing belt which is not shown. A conveyor motor 35 conveys the recording medium 112 when the recording is started and stopped, as well as for effecting a line feed of the recording medium after completion of data for one line of recording. Numerals 31A and 35A are drivers for the carriage motor 31 and the conveyor motor 35. These drivers are activated in accordance with the input signal so as to cause a relative movement between the recording head 100 and the recording medium 112 both in the conveyance direction of the recording medium and the direction of the line of recording, thereby recording a desired image on the recording medium.

A recovery motor 61 is adapted to operate under the control of a driver 61A so as to bring the cap of the recovery device 110 into and out of contact with the surface of the recording head where the nozzle openings are formed and to drive a pump so as to suck the ink from the nozzle openings. A carriage home sensor 67 detects the home position of the carriage 109 and,hence, of the recording head 100. The arrangement is such that the surface of the recording head 100 in which the discharge nozzle open faces the cap of the recovery device 100 when the carriage is at the home position.

Figure 6:
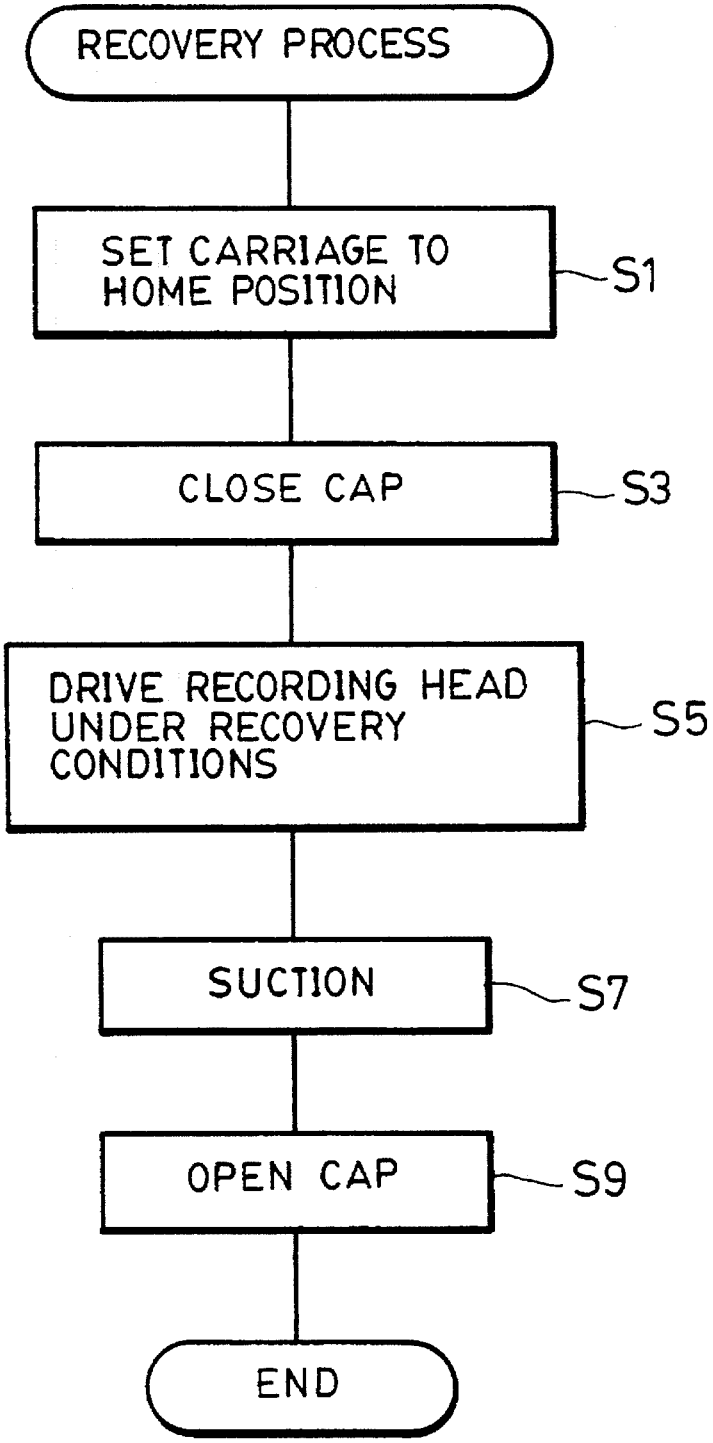
FIG. 6 is a flow chart showing an embodiment of the recovery process in accordance with the present invention.

FIG. 6 is a flow chart showing an example of the recovery process for recovering the safe discharging condition of the described embodiment of the ink jet recording apparatus. This process can be triggered automatically in response to, for example, turning on of the power supply or sensing of a discharge failure, or may be executed periodically after recording of a predetermined arbitrary quantity of data arbitrarily. It is also possible to start this process at an arbitrary timing by pressing the recovery instruction key upon visual detection of occurrence of a discharge failure.

FIGS. 7A to 7D are schematic sectional views of the ink jet head illustrative of the recovery process of this embodiment. The recovery method of the invention will be described hereinunder with reference to these Figures.

When the recovery process shown in FIG. 6 is started,the carriage 109 is set to the home position in Step S1 so that the surface of the recording head having the discharge nozzle openings is brought to a position where it faces the cap. Subsequently, Step S3 is executed to close the above-mentioned surface of the recording head 100 with the cap.

Figure 7A:
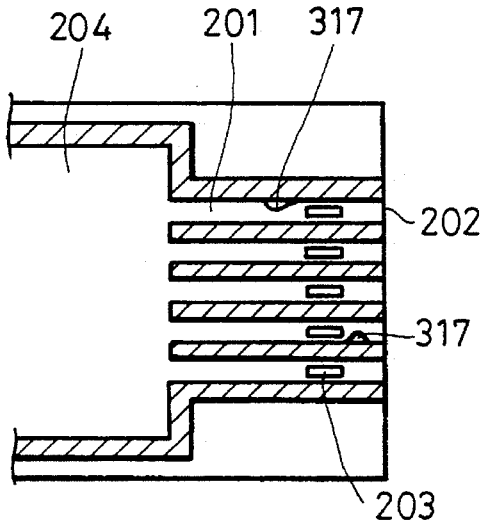
FIGS. 7A to 7D are schematic sectional views of a recording head explanatory of the embodiment of the discharge recovery process of the present invention.
Figure 7B:
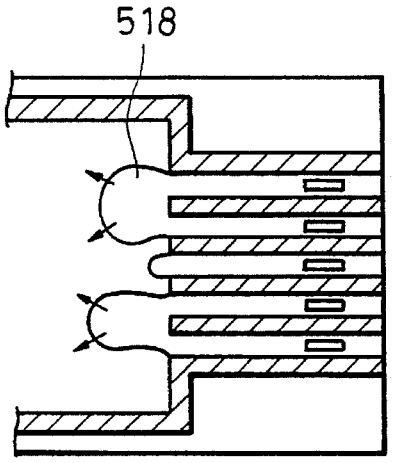
Figure 7C:
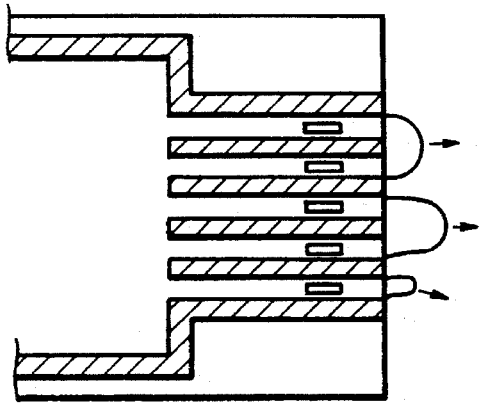
Figure 7D:
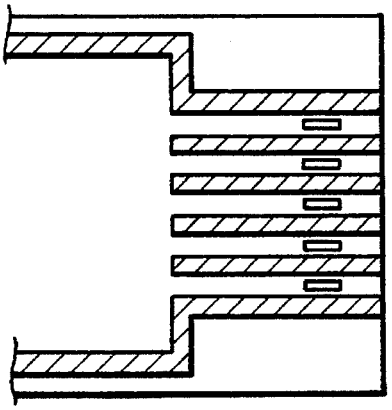

When there is a bubble 317 stagnating in the ink path 201 as shown in FIG. 7A, Step S5 is executed to activate the discharge heater 203 with a suitable condition so as to generate a multiplicity of small bubbles and to allow them to merge in a short time, whereby the ink is expelled from the ink path as shown in FIG. 7B. As a result, the stagnating bubble 317 is absorbed in the gas space so as to be extinguished. Then, the process proceeds to Step S7 in which the recovery device 110 commences a sucking operation so that the bubble 518 of the gas is discharged together with the ink from the ink path as shown in FIG. 7C. Consequently, the ink passage is refilled with the ink as shown in FIG. 7D, without allowing any gas bubble remaining in the ink paths 201 and the ink chamber 204. In Step S9, a cap is opened again to complete the recovery operation, whereby the good discharging condition can be recovered.

A test has been made to find optimum conditions of driving of the discharge heater for the recovery, the results of which are shown in Table 1.

TABLE 1

| | | fd(KHz) | | |
|---|---|---|---|---|
| Pw(μs) | V(V) | 2.0 | 4.0 | 6.0 |
| 7.0 | 26.0 | stable bubble formation | stable bubble formation | ○ |
| 7.0 | 23.5 | X | X | ○ |
| 5.5 | 23.5 | X | ○ | ○ |
| 20.0 | 21.0 | ○ | | |

In Table 1, Pw represents the pulse width of the pulse voltage applied to the discharge heater. V and fd respectively represent the voltage level and the frequency of the driving pulse supplied to the discharge heater. The ink jet recording apparatus employed in the test could form an image of a high quality when pulses of a pulse width of 7.0 μ and a voltage level of 26.0 V were applied to the discharge heater at a frequency of 2.0 KHz while the discharge response frequency of the recording head was 2.5 KHz.

Driving conditions which provided discharge characteristics equivalent to that produced by the driving condition described above are stated as "stable bubble formation" in Table 1. Conditions of driving of the discharge heater which create a bubble generating state suitable for the recovery method of the invention are marked by ○ in the table.

It will be understood that the bubble generating state suitable for the recovery method of the invention can be obtained by reducing the rate of supply of energy to the discharge heater as compared with the rate of supply of the recording energy, and that such a reduction in the energy input rate can be attained either by lowering the driving pulse voltage as compared with that for recording or raising the driving frequency as compared with that for recording or, alternatively, simultaneously adopting these two measures. Thus, satisfactory expulsion of the ink from the ink passage could be effected by adopting one or both of these driving conditions. Furthermore, satisfactory recovery of the discharge was attained by reducing the total energy input by reducing the pulse width from 7.0 μs to 5.5 μs, while maintaining the driving pulse voltage of 23.5 V and the driving pulse frequency of 4 KHz, as well as by reducing the rate of energy input per unit time through reducing the driving pulse frequency to 2.0 KHz and lowering the voltage to 21.0 V while adopting a large pulse width of 20.0 μs.

As has been described, according to the recovery method of the invention, the thermal energy generating means is driven with a condition different from that for recording, so as to allow a vapor bubble progressively to grow, thereby expelling the ink from the ink passage so as to extinguish any stagnant bubble, followed by refilling of the ink path with the ink. The amount of ink wastefully purged for the recovery by the method of the invention is much smaller than that in the conventional recovery methods which employ pressurizing or suction of the ink from the ink passage or introduction of air to an intermediate portion of the ink passage. Thus, the described embodiment of the invention enables prompt and reliable removal of any stagnant bubble in the recording head without requiring any specific mechanism and with a reduced consumption of the ink.

Figure 8:
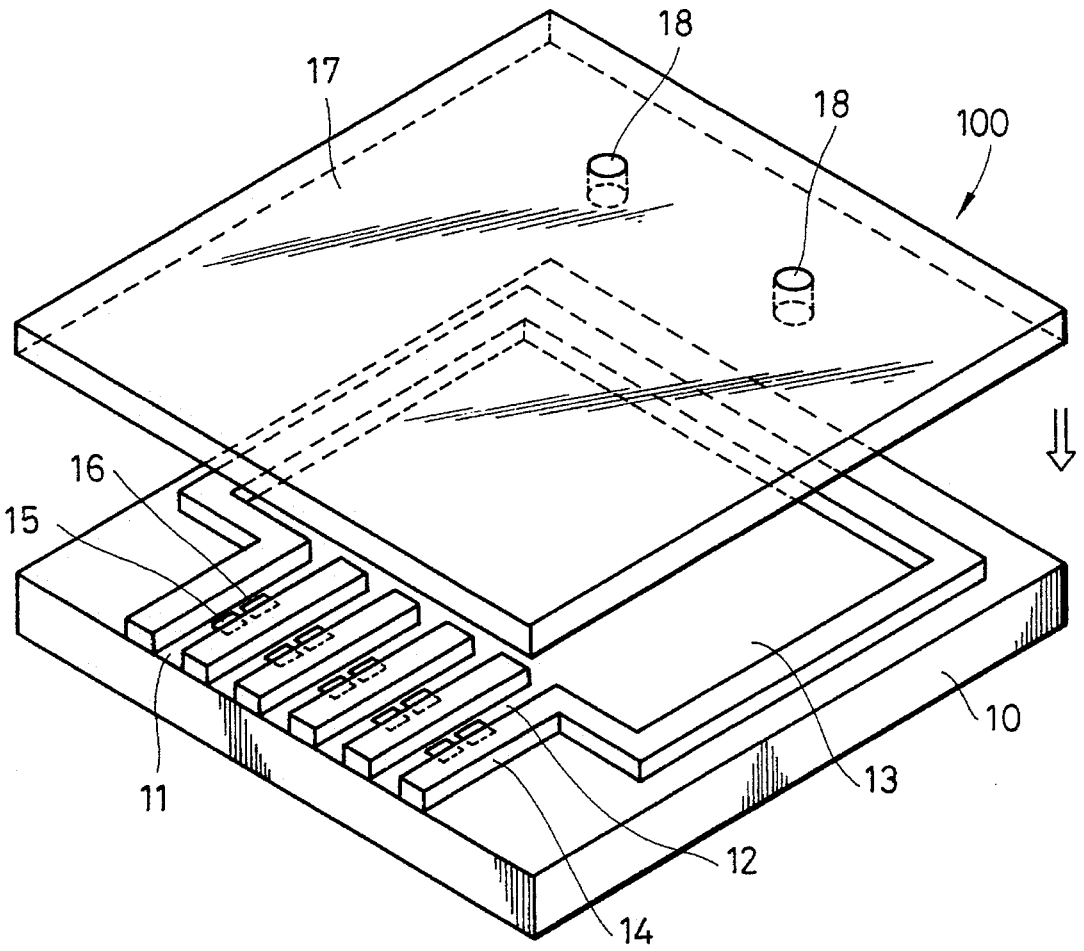
FIG. 8 is a perspective view of another example of the recording head mounted on the ink jet recording apparatus.

FIG. 8 is a schematic exploded perspective view of an example of the recording head 100 which is used in another embodiment of the ink jet recording apparatus of the present invention.

Referring to this figure, numeral 10 denotes a substrate, 11 denotes ink discharge openings, 12 denotes ink paths, 13 denotes an ink chamber common to these ink paths 12, and partition walls 14 made of, for example, a photo-sensitive resin and disposed on the substrate 10 so as to define the discharge openings 11, ink paths 12 and the common ink chamber 13.

In each ink path 12 is disposed an electro-thermal converting element (referred to as "first heating element") 15 as means for generating discharging energy for discharging the ink through the discharge opening 11. Each ink path 12 also has another electro-thermal converting element (referred to as "second heating element") 16 which is disposed upstream of the first heating element 15 and functions as a fluid diode for preventing reverse flow of the ink towards the ink chamber. Numeral 17 denotes a top plate attached to the top ends of the partition walls 14 so as to define the ink paths 12 and the ink chamber 13 in cooperation with these partition walls 14, while 18 designates ink supply ports formed in the top plate 17.

In operation of this recording head 100, the ink is discharged in the form of droplets from the discharge openings 11 at controlled timings in accordance with the driving signal supplied to the first heating element 15, while a carriage 109 carrying the recording head 100 moves relative to a recording sheet. The droplets fly towards and hit the recording sheet thereby forming an image on the sheet. The ink discharging operation will be described in more detail with reference to FIGS. 9A to 9C which are schematic sectional views of a critical portion of the recording head 100.

Figure 9A:
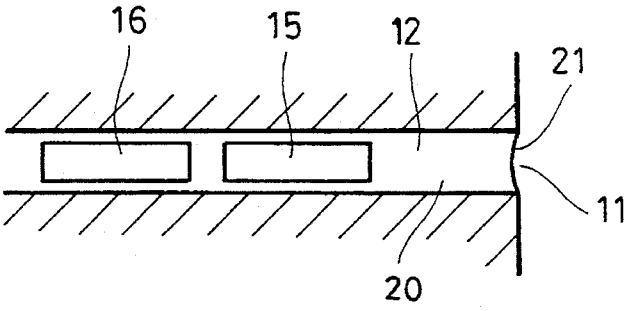
FIGS. 9A to 9C are schematic sectional views of the recording head illustrative of the state of the ink inside the recording head during discharging of ink droplets in another embodiment of the present invention.
Figure 9B:
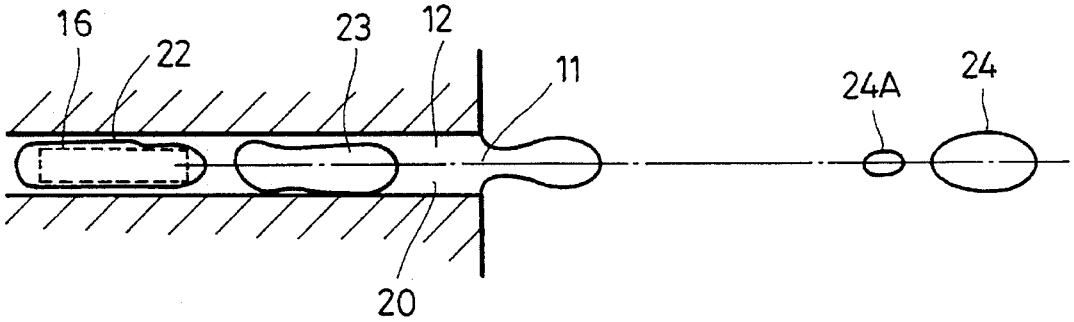

When a driving signal is not applied to the first heating element 15, the ink path 12 is filled up with an ink 20 by capillary action and a normal meniscus 21 is formed in the ink discharge opening 11 as shown in FIG. 9A. When a recording signal is supplied to the recording head 100, an energizing signal in the form of voltage pulses is supplied to the second heating element 16, so that a vapor bubble 22 is formed on the second heating element 16 as shown in FIG. 9B.

The amount of energy supplied to the second heating element 16 is controlled to be large enough to form the illustrated vapor bubble 22 but not so large as to cause the bubble 22 to discharge an ink droplet. Immediately after the formation of the bubble 22, a voltage pulse corresponding to a recording signal is supplied to the first heating element 15. When the recording head is in good condition, a main ink droplet 24 is discharged along the axis of the ink path 12 by a vapor bubble 23 formed on the first heating element 15, while the bubble 22 on the second heating element 16 serves as a fluid diode which prevents the ink from being displaced towards the common ink chamber by the force of the bubble 23 formed on the first heating element 15. In some cases, the main ink droplet 24 is accompanied by a sub-droplet 24A which is negligibly small as compared with the main droplet 24.

However, when the recording head is in a condition which requires the recovery in accordance with the present invention due to, for example, stagnation of a bubble 30 as shown in FIG. 9A, the vapor bubble 23 formed on the first heating element 15 is deformed due to the influence of tension acting on the interface between the stagnant bubble 30 and the ink. This tends to cause the ink droplets 24 and 24A to fly in a direction which deviates from the axis of the ink path, with the result that the quality of the recorded image is impaired.

Figure 9C:
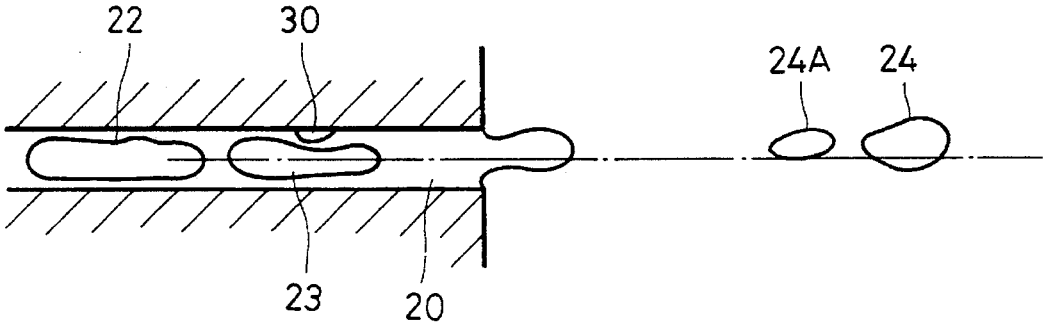

According to this embodiment of the present invention, it is possible to remove any stagnant bubble 30 in the event of a discharge failure as shown in FIG. 9C. The driving condition for the second heating element 16 is determined such that a vapor bubble 22 is generated by film boiling when recording but the bubble 22 is extinguished immediately after termination of supply of the voltage pulse to the second heating 16 so that the volume corresponding to the bubble 22 is refilled without fail. In a subsequent recovery process, the driving condition of the second heating element is suitably determined such that the ink path 12 is once filled with a gas so that the stagnant bubble 30 attaching to the wall of the ink path 12 is absorbed in the gas space inside the ink path 12, as will be understood from the following description.

Figure 10A:
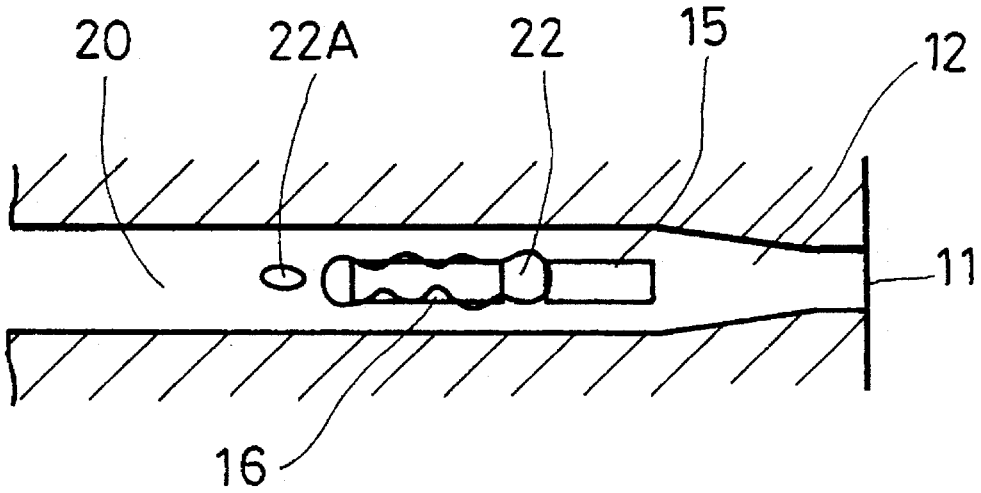
FIGS. 10A and 10B are schematic sectional views of the embodiment shown in FIGS. 9A to 9C, illustrative of the state of operation of a heating element during recovery form a discharge failure.
Figure 10B:
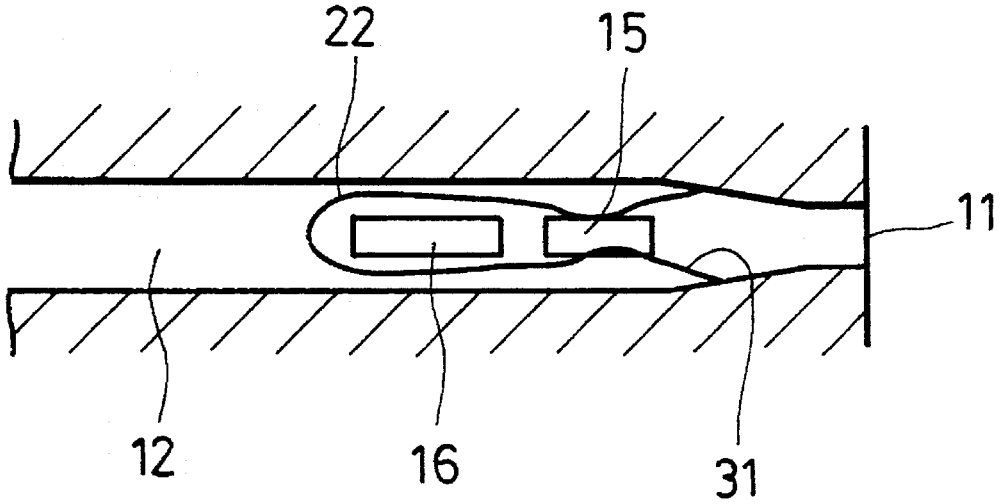

FIG. 10A and 10B are schematic sectional views of the recording head 100 showing the manner in which bubbles are formed in one of the ink paths when the first and second heating elements 15 and 16 are driven under the conditions of this embodiment. Although the ink path 12 is narrowed or restricted in the region near the outlet 11, this configuration does not produce any significant effect on the present invention.

More specifically, FIG. 10A shows the state inside the ink path obtained when the second heating element 16 is driven for the purpose of the recovery at an energy input rate which is smaller than that in the recording operation, e.g., by lowering the level of the voltage pulse as compared with that in the recording operation. It will be seen that a small vapor bubble 22A separate from the main bubble 22 has been formed as a result of the driving of the second heating element 16.

Referring now to FIG. 10A, energy is supplied to the second heating element 16 at such a large rate as to enable the heating element 16 to discharge an ink droplet by itself. In addition, the driving frequency of the second heating element 16 is determined to be greater than the response frequency of the ink meniscus, i.e., the frequency at which the meniscus is retracted as a result of driving of the second heating element 16 and then reset to the initial position. As a result, the main bubble 22 is made to merge in the retracted meniscus 31 so that any stagnant bubble in the ink path 12 is removed together with the ink.

The methods of expulsion of the ink as shown in FIGS. 10A and 10B are only illustrative and these methods may be conducted in combination. The region from which the ink is to be expelled is not limited to a part or whole of the ink path but may be expanded to cover the space inside the common ink chamber if stagnation of bubble takes place in the ink chamber. This can be done by a suitable selection of the driving conditions.

FIGS. 11A to 11D are schematic sectional views of a recording head, illustrative of the process for the recovery from the discharge failure performed by a continuous driving of the second heating element 16 with a driving condition explained in connection with FIGS. 10A and 10B.

Figure 11A:
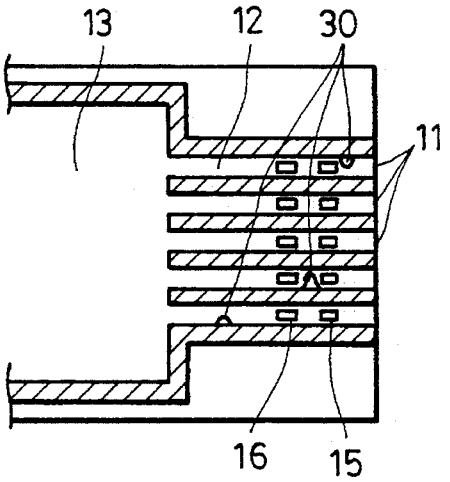
FIGS. 11A to 11D are schematic sectional view of the head, explanatory of the recovery process illustrated in FIGS. 10A and 10B.
Figure 11D:
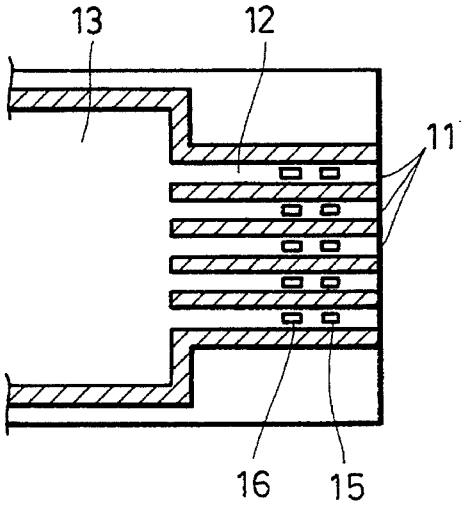
Figure 11B:
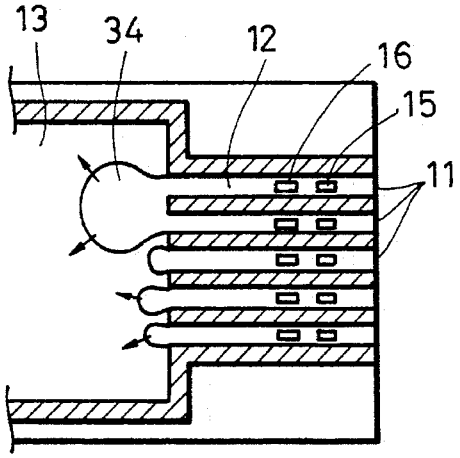
Figure 11C:
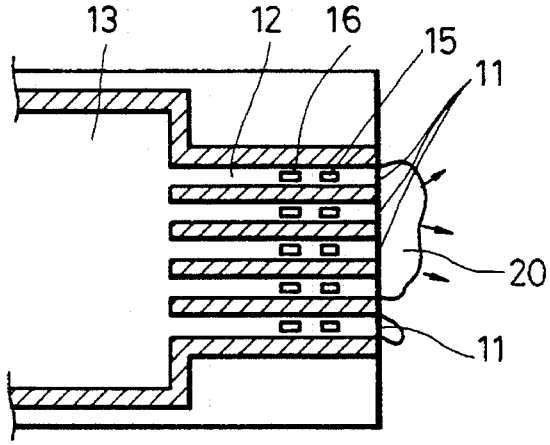

It is assumed here that bubbles 30 stagnate in some of the ink paths 12 of the recording head, as shown in FIG. 11A. By driving the second heating elements 16 under a suitable driving condition explained in connection with FIGS. 10A and 10B, a multiplicity of bubbles are generated in the ink paths and merge in one another in a short time to grow into a large voids, whereby the ink 20 is expelled from the ink paths 12 back into the common ink chamber 13 as illustrated in FIG. 11B. It is thus possible to extinguish at once the bubbles 30 stagnating in ink paths. Subsequently, as shown in FIG. 11C, a suitable means (not shown) for controlling the internal pressure of the ink passage or a suction means (not shown) connected to a cap which is selectively fitted to the discharge end of the recording head is activated so as to discharge the void 34 (see FIG. 11B) together with the ink 20 from the discharge end of the recording head, whereby the bubbles stagnating in the ink paths 12 and the ink chamber 13 are expelled, as shown in FIG. 11D. After the completion of this recovery process, the recording head is ready for discharging ink droplets in good order.

An experiment has been conducted to find suitable conditions of driving of the second heating element in the described recovery process. The results are shown in Table 2.

TABLE 2

| | | fd(KHz) | |
|---|---|---|---|
| Pw(μs) | V(V) | 2.0 | 6.0 |
| 10 | 20.5 | stable bubble formation | ○ |
| 10 | 19.0 | ○ | ○ |
| 30 | 17.5 | ○ | |

Mark ○ shows driving conditions suitable for the method of invention

In Table 2, Pw represents the pulse width of the driving voltage pulse supplied to the second heating element, while V and fd respectively show the voltage level and the frequency of the driving voltage pulses applied to the second heating element 16. The ink jet recording apparatus used in the test could properly discharge ink droplets and, hence, produce an image of a good quality when the energy generating means (first heating element) 15 was driven by driving voltage pulses of 7.0 μs in pulse width and 23.0 V in voltage with the frequency selected tone 2.0 KHz while the discharge response frequency of the recording head 100 was 3.5 KHz. During the recording operation, voltage pulses of 10 μs in pulse width Pw, 20.5 V in voltage and 2.0 KHz in frequency were applied to the second heating element 16 to enable it to operate as a fluid diode. The term "stable bubble formation" appearing in Table 2 represents the driving condition for the second heating element 16 suitable for forming the required fluid diode during recording.

In Table 2, marks ○ represent the conditions for driving the second heating element 16 capable of creating a bubble generating conditions suitable for the recovery method of this embodiment. As will be seen from this Table, the bubble generating conditions suitable for the recovery method could be obtained by setting the driving frequency fd to 6 KHz which is higher than the discharge response frequency of the recording head or by lowering the driving voltage V to 19.0 V so as to reduce the amount of the input energy by pulse. Bubble generating conditions suitable for the recovery also could be obtained when the amount of input energy per unit time was reduced by setting the driving voltage to 17.5 V while setting the pulse width Pw to 30 μs. It was confirmed that good discharging state could be recovered when the second heating element was driven under one of the above-described conditions.

Figure 12:
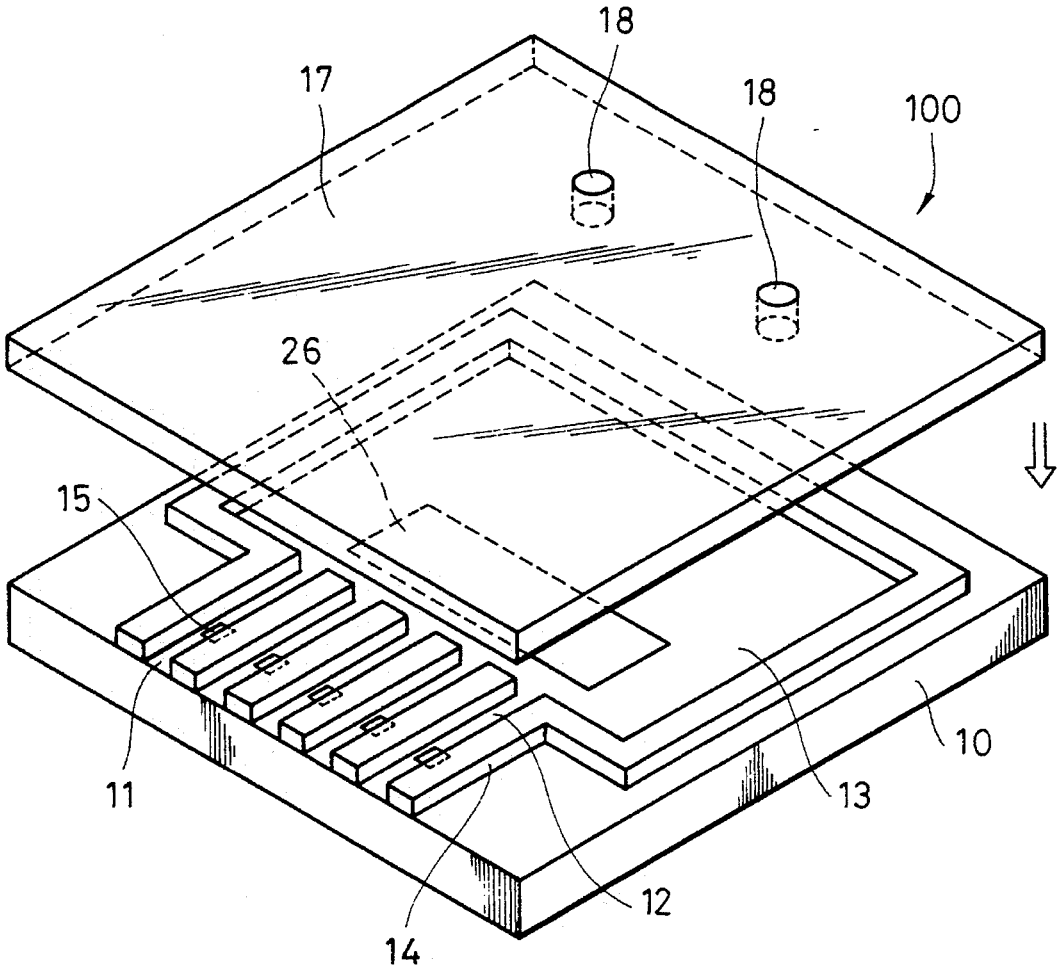
FIG. 12 is a schematic perspective view of a recording head in still another embodiment of the present invention.

FIG. 12 is a schematic exploded perspective view of a recording head used in still another embodiment of the ink jet recording apparatus of the present invention. The recording head 100 has a second heating element 26 disposed in a common ink chamber 13. The surface of the second heating element 26 has been coarsened by etching so that bubbles of vapor of an ink are generated by nucleate boiling uniformly over the entire area of the second heating element 26 when a voltage pulse of a predetermined condition is applied to this element 26. More specifically, the state of the surface of the second heating element 26 is determined inconsideration of the life of the element 26 and the rate of generation of bubbles, such that the bubbles are satisfactorily formed when the voltage pulse has a pulse width not longer than 50 μs, more preferably not longer than 30 μs.

FIGS. 13A to 13D are schematic sectional views of the recording head 100 of FIG. 12, illustrative of the operation for recovery from ink discharge failing condition conducted by continuously driving he second heating element 26 provided in the common ink chamber 13.

Figure 13A:
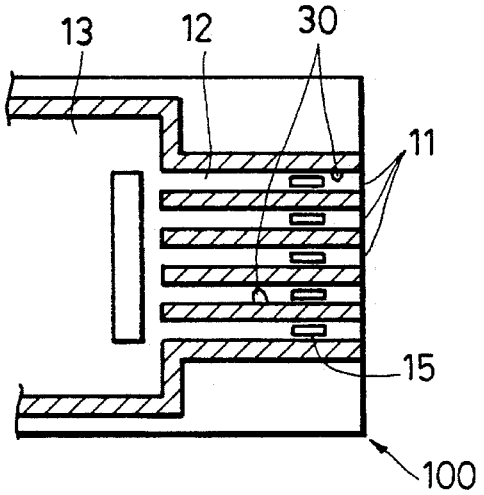
FIGS. 13A to 13D are schematic sectional view of the recording head of FIG. 12, illustrative of the operation for recovery from an ink discharging failure in the recording head.

Referring first to FIG. 13A, it is assumed that bubbles 30 stagnate in some of the ink paths 12 of the recording head 100 so that the recording head requires the recovery by the method of the invention. The second heating element 26 is then driven continuously under the above-described condition so that tiny bubbles formed by nucleate boiling on the second heating element merge in one another to form a void 25, as shown in FIG. 13B. This void remains on the second heating element 26 even after termination of supply of the voltage pulses, as shown in FIG. 13B.

Figure 13D:
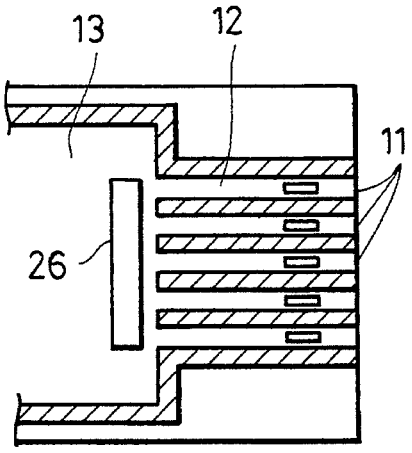
Figure 13B:
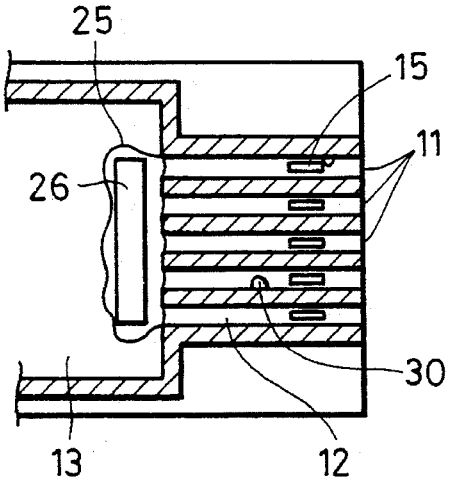
Figure 13C:
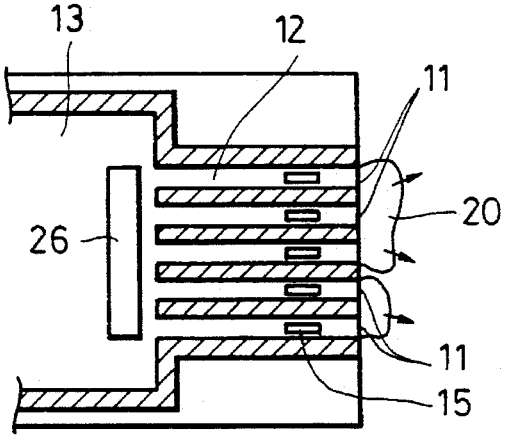

Subsequently, a pressurizing means (not shown) for applying a pressure to the space inside the ink passage is activated so that the stagnant bubbles 30 in the ink paths 12 are discharged as shown in FIG. 13C, together with the void 25 from the common ink chamber 13, whereby a good discharging state of the recording head is recovered as shown in FIG. 13D.

The embodiments described in connection with FIGS. 8 to 13D are only illustrative and can be modified in various manners. For instance, the first heating element, which is used as means for generating ink discharging energy, may be substituted by other suitable energy generating means such as a piezoelectric element. The use of a heating element as the discharge energy generating means, however, offers an advantage that the heating element itself can be used as recovery bubble generating means by being driven with a driving pulse condition which is different from that for the recording operation. Furthermore, it is possible that both the first and second heating elements are selectively operated for the recovery depending on the position or regions where the residual bubbles stagnate. The second heating element, which contributes also to the ink discharging operation in these embodiments, may be used only for the recovering purpose.

As will be understood from the foregoing description, in the embodiments shown in FIGS. 8 to 13D, in the event of an ink discharging failure, a heating means is driven with a driving condition suitable for the recovery so as to generate bubbles thereby expelling the ink from the ink path, thereby extinguishing the stagnant bubbles, followed by refilling with the ink. It is, therefore, possible to quickly remove stagnant bubbles without fail and without requiring any specific mechanism, as compared with known methods which rely upon mere pressurizing or suction of the ink or introduction of air to an intermediate portion of the ink passage. In addition, the amount of the ink wastefully discharged for the purpose of the recovery is reduced as compared with these known methods.

The present invention is particularly suitably useful in an ink jet recording head and recording apparatus of the type which discharges an ink by making use of a thermal energy. This is because the high density of the picture element, and the high resolution of the recording are possible.

The typical structure and the operational principle are disclosed in U.S. Pat. Nos. 4,723,129 and 4,740,796. The principle is applicable to a so-called on-demand type recording system and a continuous type recording system particularly however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the development and collapse of the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion in addition to the structure of the combination of the ejection outlet, liquid passage and the electrothermal transducer as disclosed in the above-mentioned patents. In addition, the present invention is applicable to the structure disclosed in Japanese Patent Laid-Open (Kokai) No. 59-123670 wherein a common slit is used as the ejection outlet for plural electrothermal transducers, and to the structure disclosed in Japanese Patent Laid-Open (Kokai) No. 59-138461 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and a plural recording head combined to cover the entire width.

In addition, the present invention is applicable to a serial type recording head wherein the recording head is fixed on the main assembly, to a replaceable chip type recording head which is connected electrically with the main apparatus and can be supplied with the ink by being mounted in the main assembly, or to a cartridge type recording head having an integral ink container.

The provision of the recovery means and the auxiliary means for the preliminary operation are preferable, because they can further stabilize the effect of the present invention. As for such means, there are capping means for the recording head, cleaning means therefor, pressing or sucking means, preliminary heating means by the ejection electrothermal transducer or by a combination of the ejection electrothermal transducer and additional heating element and means for preliminary ejection not for the recording operation, which can stabilize the recording operation.

As regards the kinds of the recording head mountable, it may be a single corresponding to a single color ink, or may be plural corresponding to the plurality of ink materials having different recording colors or densities. The present invention is effectively applicable to an apparatus having at least one of a monochromatic mode mainly with black and a multi-color with different color ink materials and a full-color mode by the mixture of the colors which may be an integrally formed recording unit or a combination of plural recording heads.

Furthermore, in the foregoing embodiments, the ink has been liquid. It may be, however, an ink material solidified at the room temperature or below and liquefied at room temperature. Since in the ink jet recording system the ink is controlled within the temperature not lower than 30° C. and not higher than 70° C. to stabilize the viscosity of the ink to provide the stabilized ejection, in usual recording apparatus of this type, the ink is such that it is liquid within the temperature range when the recording signal is applied. In addition, the temperature rise due to the thermal energy is positively prevented by consuming it for the state change of the ink from the solid state to the liquid state, or the ink material is solidified when it is left is used to prevent the evaporation of the ink. In either of case, the application of the recording signal producing thermal energy, the ink may be liquefied, and the liquefied ink may be ejected. The ink may start to be solidified at the time when it reaches the recording material. The present invention is applicable to such an ink material as is liquefied by the application of the thermal energy. Such an ink material may be retained as a liquid or solid material on through holes or recesses formed in a porous sheet as disclosed in Japanese Patent Laid-Open (Kokai) Nos. 54-56847 and 60-71260. The sheet is faced to the electrothermal transducers. The most effective one for the ink materials described above is the film boiling system.

The ink jet recording apparatus may be used as an output terminal of an information processing apparatus such as computer or the like, a copying apparatus combined with an image reader or the like, or a facsimile machine having information sending and receiving functions.

According to the present invention, at least one side of the four sides of the orifice plates are not bonded with the front seal plate, and therefore, even if the front seal is influenced by the difference in the thermal expansions of various elements, the force applied to the orifice plate can be significantly reduced, and the deformation or the crack production of the orifice plate of the top plate can be prevented.

Therefore, the cause of the print quality degrading can be removed, and therefore, the ink jet recording head cartridge and an ink jet recording apparatus using the same can be provided which can produce high quality print reliably under various conditions.

While the invention has been described with reference to the structures disclosed herein, it is not confined to the details set forth and this application is intended to cover such modifications or changes as may come within the purposes of the improvements or the scope of the following claims.

What is claimed is:

1. A recovery apparatus for recovering an ink discharging condition of an ink jet recording apparatus with recording means having an ink passage including a plurality of ink paths communicating with respective discharging openings through which ink is discharged and thermal energy generating means disposed in said passage for generating thermal energy to heat the ink in said passage, the recovery apparatus comprising:

driving means for repeatedly driving said thermal energy generating means to generate an amount of thermal energy causing nucleate boiling of the ink in said passage to form bubbles that remain in said passage and merge into a vapor region that replaces at least a part of the ink in said passage but is not used to discharge the ink from said discharging openings; and ink filling means for exhausting said vapor region through said discharge openings so as to enable said ink paths to be refilled with ink.

2. A recovery apparatus according to claim 1, wherein said thermal energy generating means includes an electro-thermal converting elements and said driving means drives said electro-thermal converting elements to generate a predetermined amount of thermal energy sufficient for causing film boiling of the ink to discharge the ink from said discharging openings for a recording operation.

3. A recovery apparatus according to claim 2, wherein said thermal energy generating means includes another electro-thermal converting element disposed in said passage upstream of said first-mentioned electro-thermal converting elements and said driving means drives said another electro-thermal converting element to create said vapor region.

4. A recovery apparatus according to claim 3, wherein said another electro-thermal converting element provides a fluid diode function to said first-mentioned electro-thermal converting element for preventing the ink from moving in a direction opposite to said discharging openings.

5. A recovery apparatus according to claim 1, wherein said passage includes an ink chamber commonly communicated to each of said ink paths, said thermal energy generating means including a plurality of electro-thermal converting elements, each being disposed in each of said ink paths, wherein said driving means drives said electro-thermal converting elements to cause said vapor region to expand and replace at least a part of the ink in said chamber and said ink paths.

6. A recovery apparatus according to claim 1, wherein said passage includes an ink chamber commonly communicated to each of said ink paths, said thermal energy generating means including an electro-thermal converting element disposed in said chamber, wherein said driving means drives said electro-thermal converting element to cause said vapor region to expand and replace at least a part of the ink in said chamber and said ink paths.

7. A recovery apparatus according to claim 1, wherein said ink filling means includes a suction pump for generating a negative pressure which exhausts said vapor region from said discharging openings.

8. A recovery apparatus according to claim 1, wherein said ink filling means includes a pressurizing pump for generating a positive pressure in said ink passage so as to exhaust said vapor region from said discharging openings.

9. A recovery apparatus according to claim 1, wherein said vapor region expands to contact a wall of said passage.

10. A recovery apparatus according to claim 1, wherein said amount of energy is generated by using a pulse voltage less than a pulse voltage used to generate a predetermined amount of energy used to discharge the ink from said discharge openings.

11. A recovery apparatus according to claim 1 or 10, wherein said amount of energy is generated by using a pulse width less than a pulse width used to generate a predetermined amount of energy used to discharge the ink from said discharge openings.

12. A method of recovering an ink discharging condition of an ink jet recording apparatus with recording means having an ink passage including a plurality of ink paths communicating with respective discharging openings through which ink is discharged and thermal energy generating means disposed in said passage for generating thermal energy to heat the ink in said passage, the method comprising the steps of:

repeatedly driving said thermal energy generating means to generate an amount of thermal energy causing nucleate boiling of the ink in said passage to form bubbles that remain in said passage and merge into a vapor region that replaces at least a part of the ink in said passage but is not used to discharge the ink from said discharging openings; and exhausting said vapor region through said discharging openings to refill said ink paths with ink.

13. A method of recovering an ink discharging condition according to claim 12, wherein said vapor region expands to a wall of said passage.

14. A method of recovering an ink discharging condition according to claim 12, wherein said amount of energy is generated by using a pulse voltage less than a pulse voltage used to generate a predetermined amount of energy used to discharge the ink from said discharge openings.

15. A method of recovering an ink discharging condition according to claim 12 or 14, wherein said amount of energy is generated by using a pulse width less than a pulse width used to generate a predetermined amount of energy used to discharge the ink from said discharge openings.

* * * * *

UNITED STATES PATENT AND TRADEMARK OFFICE

CERTIFICATE OF CORRECTION

PATENT NO. : 5,479,196

DATED : December 26, 1995

INVENTOR : GENJI INADA

It is certified that errors appears in the above-identified patent and that said Letters Patent is hereby corrected as shown below:

ON TITLE PAGE

In [54] TITLE: "RECOVERY" should read --RECOVERING--.

In [57] ABSTRACT:

Line 23, "element" should be deleted and
Line 26, "purposes purpose." should read --purposes.--.

COLUMN 1

Line 14, "all should read --an--.
Line 21, "Arts" should read --Art--.
Line 28, "deteriorated" should read --deteriorates--.
Line 47, "long" should read --long,--

COLUMN 2

Line 2, "stagnat of" should read --stagnant--.

COLUMN 3

Line 31, "form" should read --from--.
Line 33, "view" should read --views--.
Line 39, "view" should read --views--.

UNITED STATES PATENT AND TRADEMARK OFFICE

CERTIFICATE OF CORRECTION

PATENT NO. : 5,479,196

DATED : December 26, 1995

INVENTOR : GENJI INADA

It is certified that errors appears in the above-identified patent and that said Letters Patent is hereby corrected as shown below:

COLUMN 6

Line 3, "open" should read --openings are provided--.
Line 4, "device 100" should read --device 110--.
Line 12, "predetermined" should read --predetermined,-- and "data" should read --data.--.
Line 13, "arbitrarily." should be deleted.

COLUMN 8

Line 53, "heating 16" should read --heating element 16--.

COLUMN 9

Line 46, "elements 16" should read --element 16--.

COLUMN 10

Line 24, "voltage" should read --voltage,-- and "tone" should read --to be--.
Line 34, "a" should be deleted.
Line 58, "inconsideration" should read --in consideration--.

UNITED STATES PATENT AND TRADEMARK OFFICE

CERTIFICATE OF CORRECTION

PATENT NO. : 5,479,196

DATED : December 26, 1995

INVENTOR : GENJI INADA

It is certified that errors appears in the above-identified patent and that said Letters Patent is hereby corrected as shown below:

COLUMN 11

Line 50, "element," should read --element--.

COLUMN 12

Line 67, "of case," should read --case,--.

COLUMN 13

Line 16, "are" should read --is--.
Line 53, "an" should be deleted.
Line 67, "element" should read --elements--.

Signed and Sealed this

Sixth Day of August, 1996

Bruce Lehman

*Attest:*

BRUCE LEHMAN

*Attesting Officer*

*Commissioner of Patents and Trademarks*